US006555246B1

(12) United States Patent
Zwick

(10) Patent No.: US 6,555,246 B1
(45) **Date of Patent: *Apr. 29, 2003**

(54) METHOD OF PRODUCING A SOUND-ABSORBENT INSULATING ELEMENT AND INSULATING ELEMENT PRODUCED ACCORDING TO THIS METHOD

(75) Inventor: Evelyn Zwick, Ebmatingen (CH)

(73) Assignee: Rieter Automotive (International) AG, Zollikon (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/889,355

(22) PCT Filed: Feb. 2, 2000

(86) PCT No.: PCT/CH00/00058

§ 371 (c)(1),
(2), (4) Date: Jul. 17, 2001

(87) PCT Pub. No.: WO00/46493

PCT Pub. Date: Aug. 10, 2000

(30) Foreign Application Priority Data

Feb. 2, 1999 (CH) ..... 0192/99

(51) Int. Cl.[7] ..... F01N 7/14; F02B 77/11; F02B 77/13

(52) U.S. Cl. ..... 428/596; 428/604; 428/613; 29/896.6; 181/290

(58) Field of Search ..... 181/290, 291, 181/292; 428/596, 613, 603, 604; 29/6.1, 896.6; 72/379.6, 324, 252.5

(56) References Cited

U.S. PATENT DOCUMENTS

| | | | | | |
|---|---|---|---|---|---|
| 2,004,747 | A | * | 6/1935 | Daly | 428/597 |
| 2,076,807 | A | * | 4/1937 | Burgess | 156/223 |
| 2,384,847 | A | * | 9/1945 | Perry | 126/214 C |
| 2,688,581 | A | * | 9/1954 | Stubbs | 156/231 |
| 2,969,586 | A | * | 1/1961 | Victor | 428/597 |
| 3,074,505 | A | * | 1/1963 | Schulz | 181/290 |
| 4,092,842 | A | | 6/1978 | Oser et al. | 72/379 |
| 4,318,965 | A | * | 3/1982 | Blair | 219/78.02 |
| 4,326,909 | A | * | 4/1982 | Slavik | 156/253 |
| 4,343,866 | A | | 8/1982 | Oser et al. | 428/593 |
| 4,467,953 | A | | 8/1984 | Yamamoto | 228/116 |
| 5,424,139 | A | | 6/1995 | Shuler et al. | 428/596 |
| 5,670,264 | A | * | 9/1997 | Sheridan | 428/594 |
| 5,800,905 | A | * | 9/1998 | Sheridan et al. | 156/219 |
| 5,939,212 | A | * | 8/1999 | Ragland et al. | 428/594 |
| 5,958,603 | A | * | 9/1999 | Ragland et al. | 428/595 |
| 6,352,787 | B1 | * | 3/2002 | Zwick et al. | 228/115 |

FOREIGN PATENT DOCUMENTS

| | | | |
|---|---|---|---|
| EP | 0 439 046 | | 7/1991 |
| JP | 60-177902 | * | 9/1985 |
| WO | WO 94/06604 | * | 3/1994 |
| WO | WO 99/34974 | | 7/1999 |

* cited by examiner

*Primary Examiner*—John J. Zimmerman
(74) *Attorney, Agent, or Firm*—Nath & Associates PLLC; Gary M. Nath; Marvin C. Berkowitz

(57) ABSTRACT

The invention relates to a method of producing a sound-absorbent insulating element with at least two metallic leaves or sheets (2, 3) in the form of films or sheets. According to said method, at least one of said elements is provided with knobs in such a manner that the limit of elasticity of the respective sheet (2, 3) is exceeded during the knobbing process, resulting in the formation of fissures (4, 11). Said fissures substantially help to improve the acoustic absorption capacity of the insulating element produced according to the inventive method.

12 Claims, 1 Drawing Sheet

METHOD OF PRODUCING A SOUND-ABSORBENT INSULATING ELEMENT AND INSULATING ELEMENT PRODUCED ACCORDING TO THIS METHOD

BACKGROUND OF THE INVENTION

The present invention relates to a method of producing an insulating element as well as to an insulating element produced according to the method.

Such insulating elements are preferably employed in the automobile industry and are used, for example, between the hot catalytic converter and the vehicle floor.

DESCRIPTION OF THE PRIOR ART

Such insulating elements are known and are described, for example, in PCT-application WO91/10560 or U.S. Pat. No. 5,424,139. WO91/10560 describes a heat shield with a foil packet which has heat conveying zones, so-called heat-sinks, and comprises heat insulating zones. In particular, the individual foils of the foil packet have embossments or knobs which result in the stacked foils being spaced from each other. The individual foils can be hermetically closely connected with each other, thus permitting the enclosure of a gas, for example xenon. In a further development of this known heat shield, and for improving its acoustical efficacy, the individual foils are perforated. In practice, the edge regions of these foil stacks are compacted without the application of any substantial pressure, cut and subsequently beaded, heat-sealed or mechanically bonded.

In U.S. Pat. No. 5,424,139 an insulating element is described which comprises a stack of several thin metal sheets, between which sheets a metallic web or a stretched metal spacer is inserted.

It has been shown that the acoustical efficacy of these foil stacks depends largely upon the perforations, the choice of material and the spacing between the individual foil sheets. In order to be able to select/predetermine these parameters, suitable foils—preferably aluminium foils—are guided over spiked rollers and/or knobbed rollers. If the expert wishes to alter either the knob form or knob density, the perforation density or the size of the individual perforations, extensive alterations to the tools must first be undertaken.

It is therefore a task of the present invention to provide a method for producing a sound absorbing insulating element, and in particular for producing a sound absorbing heat shield, whereby only a few processing steps are involved and adjustments or changes to the foil parameters can easily be made. In particular it is the aim of this method to allow for easy and inexpensive adjustments to be made to the perforation density and to the air-flow resistance created by such perforations.

SUMMARY OF THE INVENTION

This task is solved by a method of producing a sound-absorbing insulating element, having at least two metallic sheets in the form of foils or metal sheets, of which at least one is embossed, and said sheets being joined and formed together, wherein at least one fissured sheet is produced when, during embossing, the material of the at least one metallic sheet is overstretched to such an extent that fissures are created, and in particular by a method for producing a sound absorbing insulating part having at least two metal sheets which can be in the form of foils or thin metal lamellae. In one process step of the method, the material of at least one metal sheet is knobbed, and in a further process step this knobbed sheet is connected with at least a second metal sheet. During the knobbing or embossing of the at least one metal sheet the limit of elasticity of the sheet material is exceeded to such an extent that hairline cracks or fissures are created. With this inventive method it is possible to fissure thin metal just as well as thick foils, or leaves in the form of stretched metal sheets can be used. Furthermore, it is particularly advantageous to use aluminum as material for these leaves or sheets.

A particularly advantageous embodiment of the inventive method provides for cold-soldering the individual metal layers, in particular foils or leaves, to each other. In the following, the concept of "cold-soldering" is used to mean a metallurgical connection which is created by a plastic deformation of two or more neighboring/adjacent foils or leaves, during which metallurgical connection the metal of adjacent leaves undergoes a material connection. If the metal is aluminium, such a metallurgical connection is achieved when adjacent leaves are compressed by, for example, 75%.

Furthermore it is a task of the present invention to provide an insulating element, in particular a heat shield, having an improved and easily optimizable acoustical efficacy.

This task is solved by a sound absorbing insulating element, in particular a sound-absorbing heat shield, wherein the heat shield comprises at least two metallic sheets in the form of foils of metal sheets of which at least one comprises a plurality of knobs and fissures and which sheets are joined together, and in particular by a sound absorbing heat shield comprising at least two metal sheets, whereby the at least one metal sheet comprises a plurality of knobs and/or fissures and is connected to the at least second sheet and is shaped into a formed insulating element. It is particularly advantageous if these metal sheets are made of aluminum.

The inventive method has proven to be surprisingly easy to employ and leads to sound absorbing insulating elements having a surprisingly good sound absorption.

BRIEF DESCRIPTION OF THE DRAWINGS

The invention is described in the following with the aid of the drawings and the subsequent description of a preferred embodiment.

DESCRIPTION OF THE PREFERRED EMBODIMENT

Figure 1:
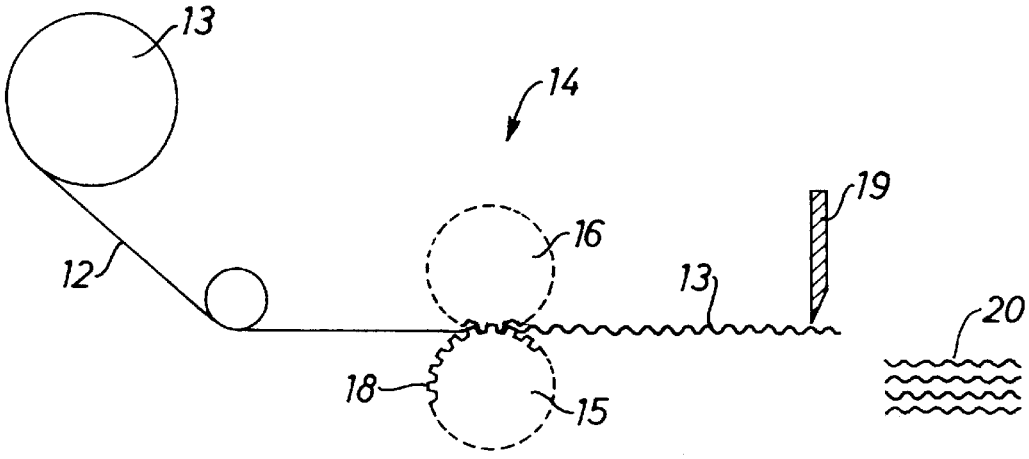
FIG. 1 shows a schematic representation of the production method according to the invention.

For producing the insulating elements according to the present invention, a preferred embodiment of the method provides for continuously unrolling a web-shaped metal foil 12 off a roll 13 and conveying this through a roller arrangement 14 for embossing. This roller arrangement 14 essentially comprises an embossing roller 15 and a counter roller 16, which counter roller 16 can be coated with an elastic material or can be provided with a sieve-like structure cooperating with the embossing roller 15. This counter roller 16 presses the metal foil 12 against the embossing structure or knobs of the embossing roller 15. According to the invention, the arrangement of the knobs on the embossing roller 15 and on the counter roller 16 is coordinated such that the foil 12 is partially torn during embossment in this roller arrangement 14. By simple choice of the elastic coating material of the counter roller 16 or by suitable spacing of the rollers it is possible to influence the number and size of the fissures 4, 11 in the foil 12 occurring during embossment. The brittleness or elasticity of the foil material to be embossed must be taken into consideration. The thus fissured foil 13 is subsequently cut 19 in a conventional manner and stacked 20. It is understood that this method can also be carried out discontinuously and that the roller arrangement 14 can be replaced by suitable pressure plates.

To produce an insulating element according to the invention, the fissured sheets are combined with similar or different metal sheets and are shaped and joined together in a conventional manner.

According to the invention, during embossment in the roller arrangement 14 the limit of elasticity of the metallic material of the foil 12 is exceeded to such an extent that a plurality of irregularly spaced fissures 4, 11 are created. Surprisingly, and in comparison to needle-type perforations, these fissures 4 dissipate acoustic energy better and allow sound absorbing insulating elements, in particular heat shields, to be produced which have an improved acoustic efficacy. Furthermore, these fissured foils enable a simple method of varying and adjusting the air flow resistance at the surface of an acoustically effective insulating part, so that an optimal sound dissipation can be achieved for all forms of the insulating elements. According to the inventive method, the number, density and length of the fissures can determine this optimization or adjustment.

It is particularly advantageous if a brittle and thus easily fissurable material is used, as this enables a satisfactory creation of fissures during embossment. Depending upon the choice of material used, the foil strength or foil sheet thickness as well as the shaping of the roller arrangement 14, it is possible to create fissures 4, 11 having different lengths. Thereby it is possible to achieve a high density of short fissures 4 (which occur, for example, at locations of maximum expansion, that is at the knob heads 10) and a lower density of longer fissures 11, which extend over two or more knobs 5.

After embossing the material of the web 12 is cut into predetermined lengths and is stacked. In a simplest embodiment of the method for producing sound absorbing insulating elements, at least a first sheet, fissured as described above, is positioned on top of a second metal sheet and are joined together by beading, tacking, gluing or cold soldering. As a second metal sheet a foil or a sheet metal can be used, which can be perforated or unperforated, and in particular can be fissured, which can be knobbed, ribbed or unformed, which can be more or less rigid, which can have different thicknesses or can be used in the form of a stretched metal.

As described above, the concept of "cold soldering" is used to mean a metallurgical connection which occurs by means of a plastic deformation of two or more neighboring or adjacent sheets, during which deformation the metallic material of adjacent sheets undergoes a material connection. If the metal is aluminium, such a metallurgical connection is achieved when adjacent sheets are compressed by, for example, 75%.

It is to be understood that the production method as described above can be further automated, for example, by simultaneously taking the different sheets from various rollers or stacks and then jointly cutting, forming and/or cold-soldering these.

Figure 2:
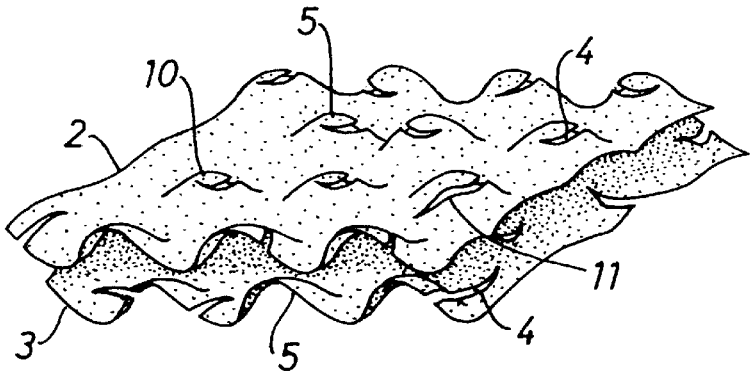
FIG. 2 shows a schematic representation of two sheets/leaves produced and stacked according to the invention.

FIG. 2 shows two sheets 2, 3 fissured and stacked according to the invention. These sheets have a plurality of knobs 5 which ensure that the two sheets 2, 3 are distanced from each other. The fissures 4, 11 created by the inventive method are essentially located in the region of the ridge 10 of the knob, because, during embossing, the over-expansion of the material is most pronounced and, in accordance with the invention, the limit of elasticity of the material is exceeded. It is understood that by selection of the leaf material the number and length of the individual fissures 4, 11 can be varied. It is also up to the expert to design the specific shape of the knobs, i.e. to design the individual knobs 5 as semi-spherical, blunt conical, pyramidal, square or cylindrical protrusions and to choose their appropriate density, arrangement and size.

The insulating elements according to the invention comprise at least two sheets 2, 3, of which at least one is fissured. These sheets 2, 3 are preferably made of aluminium and can be perforated or unperforated, in particular can be fissured, knobbed, ribbed or unshaped, can be more or less rigid, can have varying thicknesses or can be in the form of a stretched metal. These insulating elements, when used as heat shields, can be supplemented with known supporting metal sheets or with metallic insulating materials or fleeces.

What is claimed is:

1. Method of producing a sound-absorbing insulating element, having at least two metallic sheets in the form of foils or metal sheets, of which at least one is embossed, and said sheets being joined and formed together, wherein at least one fissured sheet (2) is produced when, during embossing, the material of the at least one metallic sheet is overstretched to such an extent that fissures (4) are created.

2. Method according to claim 1, wherein at least one sheet is used in the form of a stretched metal.

3. Method according to claim 1, wherein, whilst embossing the material of the at least one sheet, blunt conical knobs are created.

4. Method according to claim 1, wherein aluminium is used as material for the sheets.

5. Method according to claim 1, wherein the metallic sheets are cold-soldered together at their edge regions.

6. Sound-absorbing element, produced according to the method of claim 1, wherein the heat shield comprises at least two metallic sheets in the form of foils of metal sheets of which at least one comprises a plurality of knobs (5) and fissures (4, 11) and which sheets (2, 3) are joined together.

7. Insulating element according to claim 6, wherein this comprises at least one sheet in the form of a stretched metal sheet.

8. Insulating element according to claim 6, wherein the knobs have a blunt conical shape.

9. Insulating element according to claim 6, wherein the metallic sheets are of aluminium.

10. Insulating element according to claim 6, wherein the metallic sheets are cold-soldered together at their edges.

11. Method of producing a sound-absorbing insulating element according to claim 1 wherein said sound-absorbing insulating element comprises a sound-absorbing heat shield.

12. Sound-absorbing element according to claim 6 wherein said sound-absorbing element comprises a sound-absorbing heat shield.

* * * * *